United States Patent [19]

Dubois et al.

[11] Patent Number: 4,689,034

[45] Date of Patent: Aug. 25, 1987

[54] FIGURE TOY WITH PROJECTILE LAUNCHING MECHANISM

[75] Inventors: Craig Dubois, Granby; Dominic G. Mercurio, Elmwood, both of Conn.

[73] Assignee: Coleco Industries, Inc., West Hartford, Conn.

[21] Appl. No.: 827,335

[22] Filed: Feb. 7, 1986

[51] Int. Cl.[4] ..... A63H 3/20

[52] U.S. Cl. ..... 446/309; 446/330; 446/368; 446/435

[58] Field of Search ..... 446/309, 330, 359, 368, 446/376, 378, 433, 435

[56] References Cited

U.S. PATENT DOCUMENTS

| | | |
|---|---|---|
| Re. 30,703 | 8/1981 | Paulson et al. . |
| 188,841 | 3/1877 | Baxter . |
| 476,895 | 6/1982 | Pyle . |
| 699,780 | 5/1902 | Woerner . |
| 2,185,091 | 12/1939 | Orlando et al. . |
| 2,263,602 | 11/1941 | Whittle . |
| 3,101,569 | 8/1963 | Giardina . |
| 3,236,223 | 2/1966 | Rockwood . |
| 3,398,956 | 8/1968 | Lukes . |
| 3,664,670 | 5/1972 | Glass et al. . |
| 4,150,508 | 4/1979 | Ogawa . |
| 4,262,445 | 4/1981 | Orenstein . |
| 4,301,615 | 11/1981 | Ikeda . |

*Primary Examiner*—Kenneth Downey

[57] ABSTRACT

A creature figure toy having walking action capability utilizes a pair of ring members which are mounted for counter-rotation within the body. Projectile launching means is also incorporated.

12 Claims, 8 Drawing Figures

FIGURE TOY WITH PROJECTILE LAUNCHING MECHANISM

BACKGROUND OF THE INVENTION

An ongoing demand exits for action toys having novel features. It is of course important that any such toy be effective in its appearance and operation, while also being durable and relatively facile and inexpensive to manufacture. The prior are discloses numerous forms of action toys in which various parts can be moved in different ways, and which achieve a wide diversity of effects; typical are the following U.S. Pats:

Baxter U.S. Pat. No. 188,841 discloses a toy in the form of a simulated tortoise, wherein each of two pieces includes a pair of legs, the pieces being pivotable within the body and actuated by a spring-operated propelling wheel.

In Pyle No. 476,895, a mechanical toy is provided in which a pigeon is catapulted from a base and, at the limit of its flight, pulls upon an attached string; this actuates a gun-holding figure, and fires a cap contained in the gun piece.

Woerner No. 699,780 shows a foot rest in the form of a turtle, wherein a lazy-tongs arrangement serves to actuate simulated legs.

A toy archer is disclosed in Orlando et al No. 2,185,091, which includes an arrow having a pin that is engaged by a catch. Pressure upon a lever causes the catch to pull the arrow along a slot in a mounting tube, which is then fired by camming the catch out of engagement.

Whittle No. 2,263,602 shows apparatus for rotating and projecting a bowling ball; the ball is rotated by an electric motor, and is projected by sharply thrusting the device forwardly, causing the curved supporting arm to lift slightly and thereby to permit the ball to roll out of the machine.

Pat. No. 3,101,569 to Giardina discloses a latch/-plunger arrangement for launching a toy airplane.

Rockwood No. 3,236,223 shows a bowling ball propelling device, in which a motor imparts rotation and a pneumatic cylinder imparts a linear force to the ball.

In Lukes No. 3,398,956, missiles, propelled by rubber bands, are launched by disengagement of interfitting projections on the missle and supporting structure.

Glass et al No. 3,664,670 relates to a doll game, wherein the doll has a motor-driven arm for launching balls, of the ping pong type, when actuated by a lever.

Ogawa No. 4,150,508 discloses a toy vehicle with a firing mechanism, and includes a crossbar which supports an elastic band. The elastic band is stressed by a trigger piece, and is released by pivoting the trigger to propel the projectile from the unit.

In Orenstein No. 4,262,445, a spring-actuated articulated ball-throwing arm includes a delayed action feature, provided by an incorporated suction cup arrangement.

Ikeda No. 4,301,615 provides a mechanical turtle having legs and a head that extend and retract, and a tail that spins.

Reissue, Pat. No. 30,703, to Paulson et al, discloses a device for throwing a ball, wherein a wheel is driven at a predetermined speed to propel the ball at selected velocity.

An action toy having an object-launching turret, which may have movable appendages and may be in the form of a turtle-like creature, is described and claimed in copending application for Letters Pat. Ser. No. 06/827,340 Feb. 7, 1986, entitled FIGURE TOY WITH WALKING ACTION AND LAUNCHING MECHANISM FOR FLYING ELEMENT, which is of common assignment herewith.

It is an object of the present invention to provide a novel creature toy having movalbe appendages, and more particularly to provide such a toy wherein animation is achieved in a unique manner.

A more specific object of the invention to provide such a creature toy which is of turtle-like form and is capable of simulating a walking action.

Another object of the invention is to provide a novel action toy, of creature-like form, which has a turret assembly mounted thereon to provide an object-launching feature.

Additional objects of the invention are to provide such a toy which is effective in its appearance and utility, is durable, is uncomplicated and comprised relatively few parts, and which is relatively facile and inexpensive to manufacture.

SUMMARY OF THE INVENTION

It has now been found that certain of the foregoing and related objects of the invention are attained by the provision of a creature toy comprised of a body having mounting means therewithin, a superimposed pair of ring members disposed upon the body mounting means for rotation about a common axis, and means attached to the ring members for biasing them in opposite directions about the axis of rotation. Each of the ring members has an actuating element thereon which is accessible externally of the body, as well as having at least one appendage projecting from the body. The construction provided enables counter-rotation of the ring members to be effected by the application of simultaneous force upon the actuating elements, to achieve animation of the appendages.

In the preferred embodiments, the ring members will be substantially identical and disposed in an inverted relationship to one another. Each ring member will normally comprise an annular portion from which the actuating element and appendage project outwardly in a non-diametric relationship, and the ring members will desirably be placed to position the actuating elements adjacent to one another and with the appendages symmetrically disposed on the body.

Most desirably, the biasing means employed will act between the two ring members; usually it will exert a separating bias upon the actuating elements, so that animation of the appendages can be effected by alternately squeezing together and releasing those elements. Each of the ring members will desirably have a plurality of appendages thereon, arranged to dispose at least one appendage on each side of the body and directly adjacent an appendage of the other ring member. This will cause the appendages on each side to move toward and away from one another, to simulate a walking action when the ring members are counterrotated.

The mounting means employed will advantageously comprise a generally cylindrical seat portion disposed within the body, in a normally vertical orientation, and preferably the seat portion will be slightly tapered in the upward direction. Each of the annular elements of the ring members may be provided with a multiplicity of inwardly projecting rib formation at equidistantly spaced locations thereabout, to provide bearing surfaces in contact with the sidewall of the seat portion. In a specific form of the toy, the body, appendages and actuating elements may be configured, respectively, to resemble the body, limbs and tail of a turtle-like creature.

Additional objects of the invention are attained by the provision of a creature toy having the foregoing features which, in addition, includes a turret assembly. In such an embodiment the body will have a top wall portion in which is defined an upwardly opening recess of circular cross section. The turret assembly will have a circular base member rotatably mounted within the body recess, and it will include an upstanding turret member having object-launching means thereon.

DETAILED DESCRIPTION OF THE ILLUSTRATED EMBODIMENT

Figure 1:
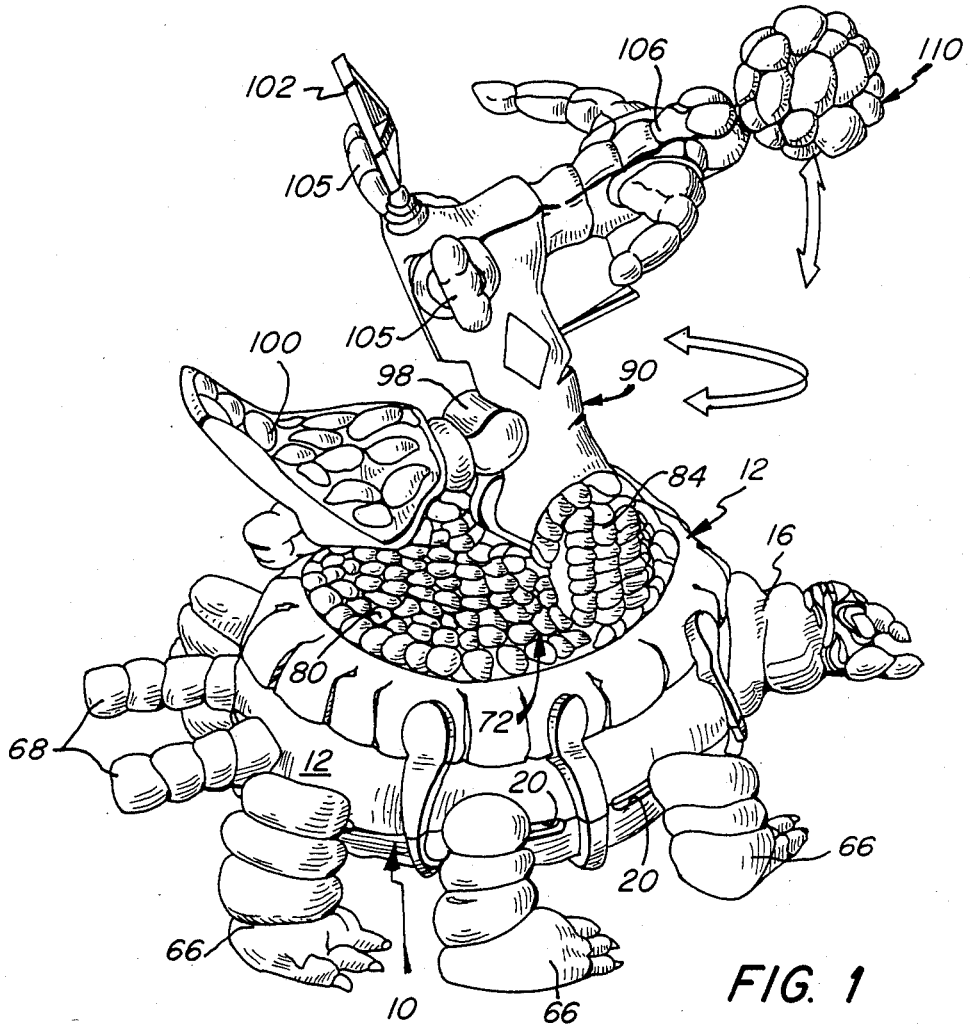
FIG. 1 is a perspective view of a creature toy embodying the present invention.
Figure 2:
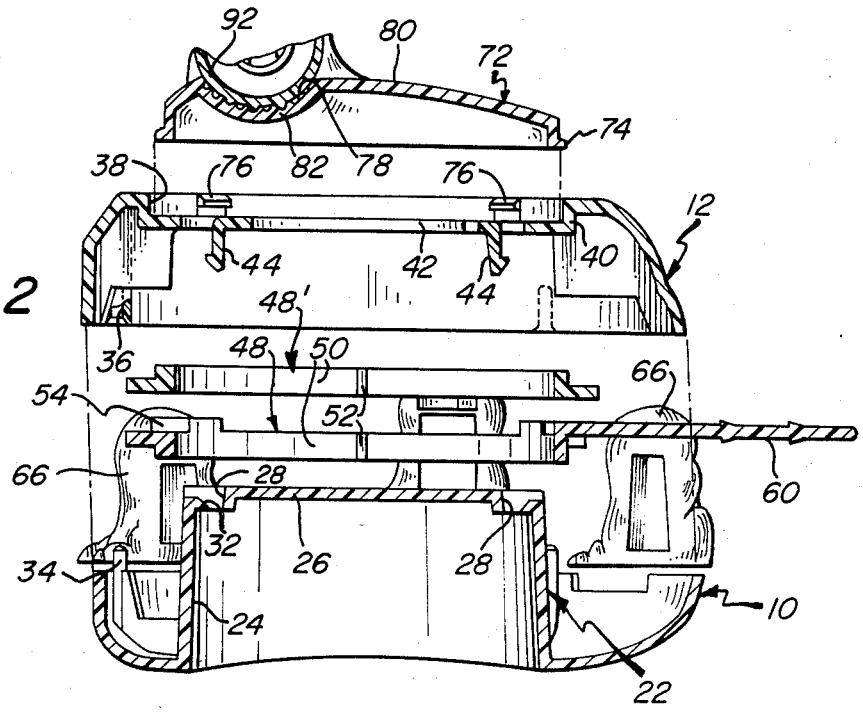
FIG. 2 is an exploded, fragmentary sectional view of the toy taken along line 2/5—2/5 of FIG. 6.

Turning now in detail to the appended drawings, therein illustrated is a creature toy embodying the present invention and comprised of a body assembly and a turret assembly mounted thereupon. The body assembly consists of a lower and an upper body section, generally designated respectively by the numerals 10, 12. The body sections cooperatively define an opening 14 in the forward part, within which is mounted a head-simulating piece 16 having a circumferential groove 18 which engages elements of the body sections to secure it in place. Also defined by the body sections are a number of elongated lateral slots 20, spaced about the periphery thereof.

An upstanding, substantially cylindrical seat portion, generally designated by the numeral 22, is formed into the bottom section 10. It consists of a sidewall portion 24, which is slightly tapered in the upward direction (i.e., in the normal orientation of the toy), and a top wall portion 26 which extends across the upper end thereof. The top wall portion 26 has four rectangular apertures 28 formed through it at equidistantly spaced locations; a bevelled edge element 32 leads into each of the apertures 28.

Figure 3:
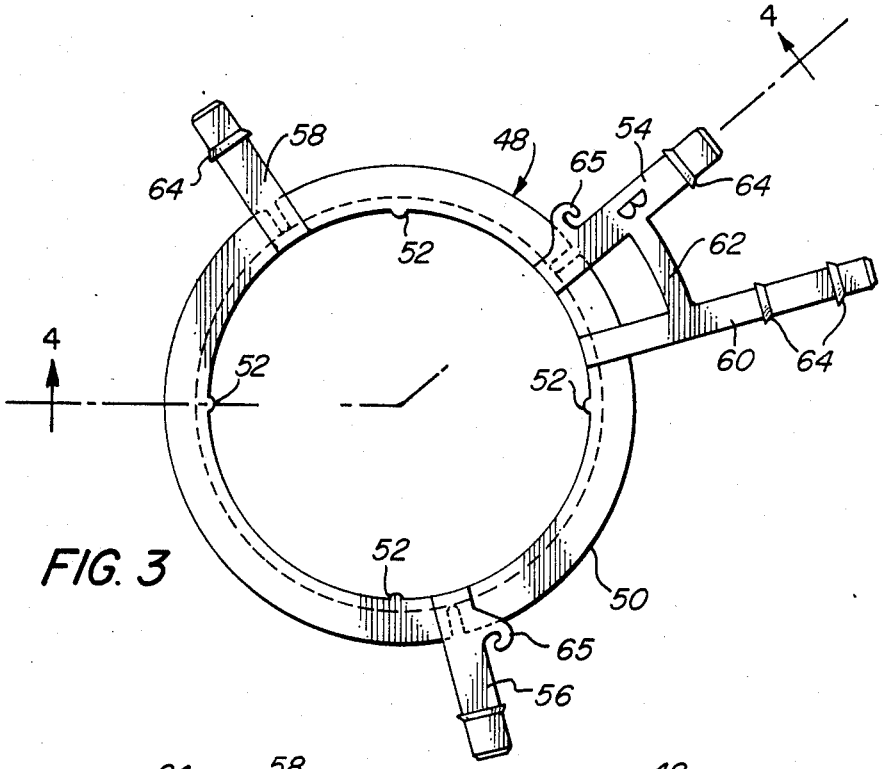
FIG. 3 is a plan view of a ring piece employed in the toy for mounting and animating leg-simulating elements.
Figure 4:
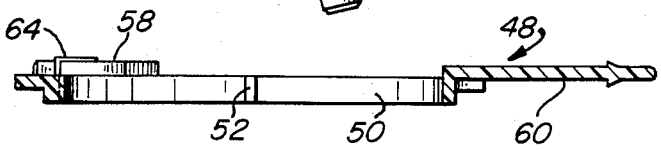
FIG. 4 is a sectional view of the ring piece of FIG. 3, taken along line 4—4 thereof.

The upper body section 12 is dimensioned and configured to mate with the lower section 10, and a series of pins 34 and apertures 36 are provided on the two sections to facilitate assembly; the apertures may be formed with conventional crush ribs, and parts may be permanently secured together, such as by ultrasonic welding, adhesive bonding, or a similar technique. A shallow circular recess 38 is formed into the upper section 12, and is defined by a low cylindrical sidewall portion 40 and an annular bottom wall portion 42. Four hook elements 44 depend from the annular wall protion 42 at equidistantly spaced locations thereabout; they extend through the apertures 28 of the top wall portion 26 of the lower section, and engage under the adjacent structure to secure the sections at those locations. Disposed within the body of the toy are two ring pieces, shown most clearly in FIGS. 3 and 4 and generally designated by the numerals 48 and 48'. Since they are substantially identical, (except as pointed out below) it is necessary to describe only one of the ring pieces (48) in detail. It consists of an annular portion 50, which has four axially extending rib elements 52 thereon at equidistantly spaced locations about its inner circumference. Three supporting arms 54, 56, 58 extend radially outwardly from the annular portion 50 at spaced locations thereabout. A fourth, relatively long arm 60 extends therefrom at a point adjacent the arm 54, and a reinforcing connecting piece 64 extends therebetween; all of the arms 54–60 have barb elements 64 adjacent their outer ends. The arms 54 and 56 of the lower ring piece 48 (designated "B") have hook elements 65 thereon proximate the annular portion 50; the upper ring piece 48' (designated "T") is distinguished therefrom by having a hook element 65 on arm 54 but not on arm 56.

The ring pieces 48, 48' are mounted upon the seat portion 22 of the lower body section 10 with their rib elements 52 bearing upon the sidewall portion 24 and with the several arms extending through the body slots 20; leg-simulating caps 66 are affixed upon each of the arms 54, 56, 58, and tail-simulating caps are affixed upon the arms 60. As can best be seen in FIG. 6, the pieces 48, 48' are disposed in an inverted relative relationship and are angularly oriented with the longer support arms 60, bearing the tail caps 68, adjacent; consequently, the shorter arms 54-58 of the two ring pieces 48, 48' alternate with one another. A coil spring 70 interconnects the two ring pieces 48, 48' and serves to bias them in opposite directions; the spring is attached by engaging its opposite ends upon the hook elements 65 on the supporting arm 56 of piece 48 and on the adjacent arm 54 of the piece 48'.

Figure 5:
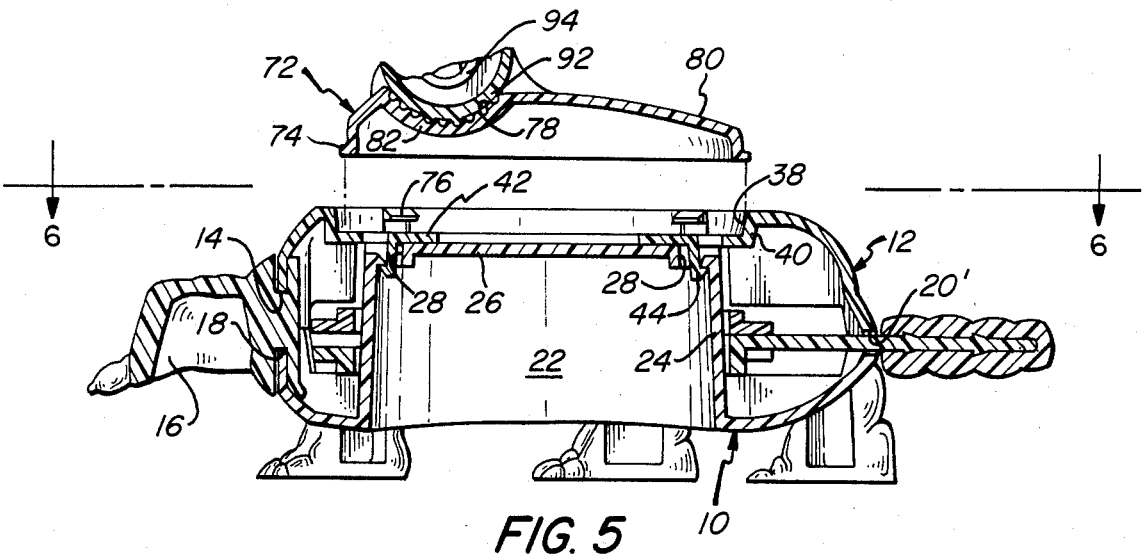
FIG. 5 is a sectional view of the body assembly of the creature toy, taken along line 2/5—2/5 of FIG. 6, also showing in vertical section parts of the turret assembly mounted thereupon.
Figure 6:
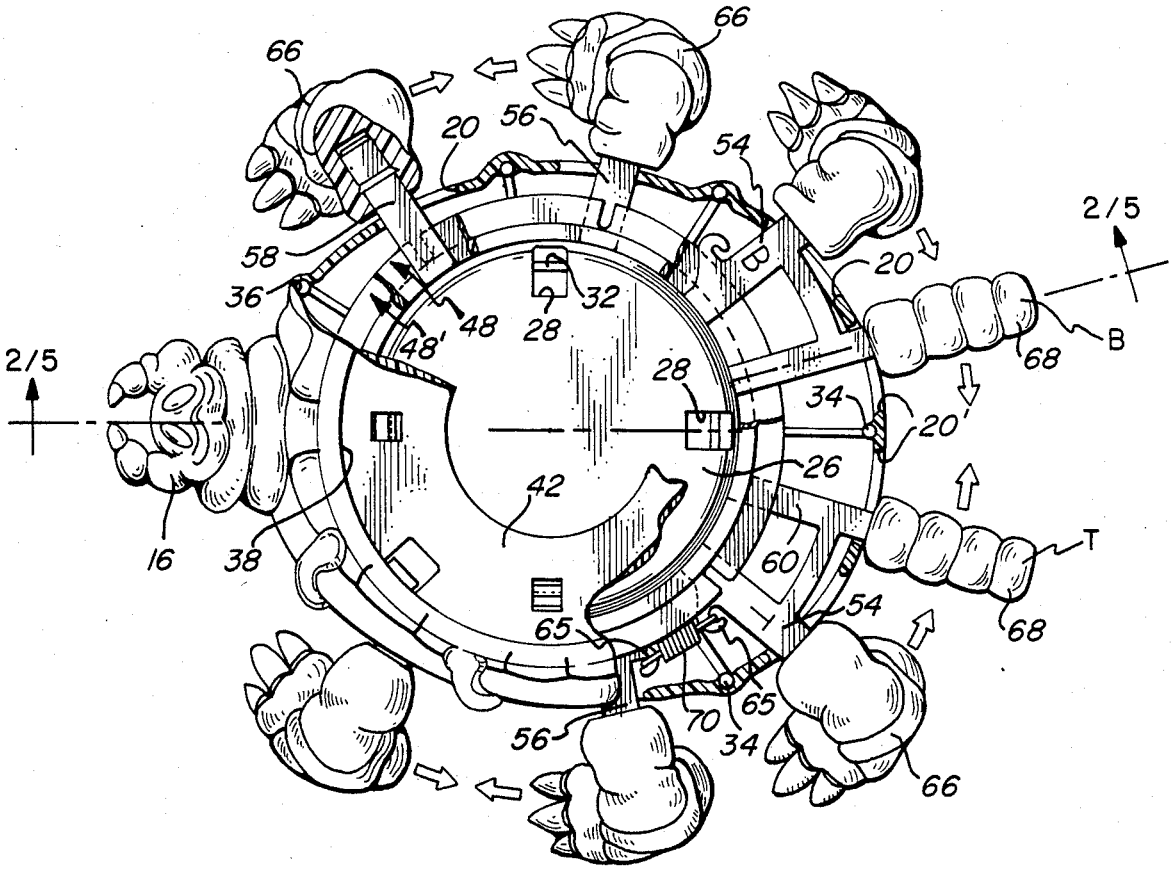
FIG. 6 is a plan view of the body assembly, shown in partial section.

The normal position of the simulated legs is shown in FIGS. 1, 5 and 6. Squeezing the actuating elements together (i.e., the arms 60 bearing tail caps 68) will cause the ring members to turn in opposite directions, with the components of the lower member "B" moving clockwise and those of the upper member "T" moving counterclockwise, as seen in FIG. 6. A walking action will thereby be produced in the creature body assembly.

The turret assembly includes a circular base member, generally designated by the numeral 72, which has a dome-like upper wall portion 80 and circumferential lip element 74 extending outwardly about its lower edge, the latter being engaged under the inwardly projecting finger elements 76 formed on the sidewall portion 40. The lower surface of the lip element 74 rides upon the upper surface of the annular wall portion 42 defining the recess 38 of the upper body section 12; thus, the base member 72 is axially fixed within the recess 38 but is freely rotatably therewithin.

An arcuate channel 78 extends inwardly on the upper wall portion 80 of the base member 72. The bottom of the channel is defined by a curved wall element 82, which has a corrugated upper surface, and the sides are defined by inner wall elements 88 of ear formations 84, which extend upwardly from the wall portion 80.

Figure 8:
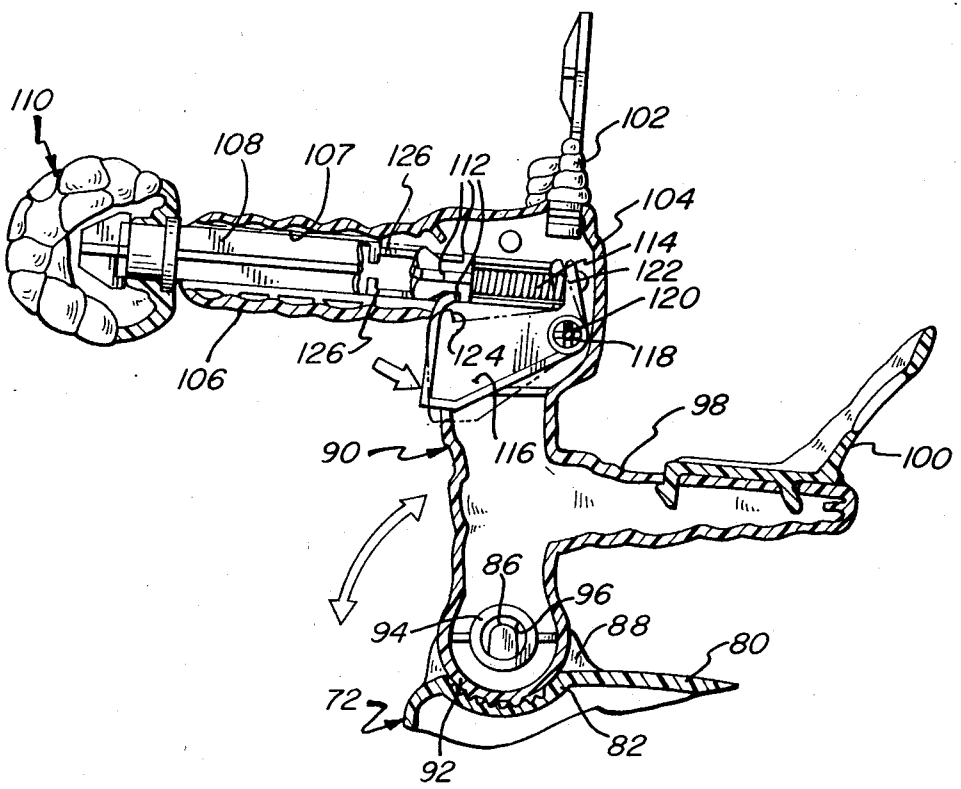
FIG. 8 is a side elevational view of the turret assembly and associated body parts illustrated in FIG. 7, shown in partial section.
Figure 7:
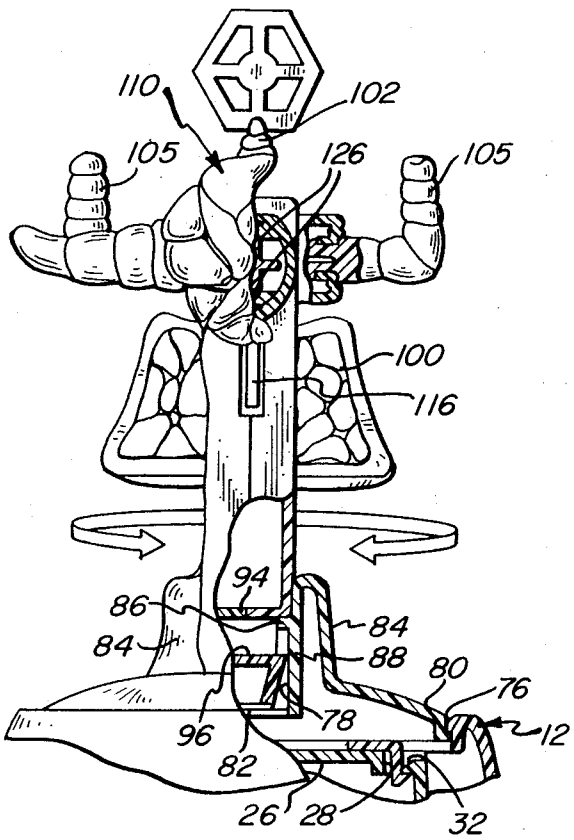
FIG. 7 is a fragmentary front elevational view of the turret assembly of the creature toy, together with associated parts of the body assembly, shown in partial section.

The turret arm, generally designated by the numeral 90, has a lower end portion defined by a wall element 92, which is of generally circular cross section and has a corrugated outer surface. A cylindrical portion 94 (comprised of cooperating elements on each side of the arm) extends through the lower portion of the arm and defines therewithin a transverse passageway 96. Generally circular collar elements 86 extend laterally toward one another, from the inner wall 88 of ear formation 84, and into the opposite ends of the passageway 96 to pivotably mount the arm 90 thereupon. As can be seen, the corrugated surfaces of the wall elements 82, 92 mesh with one another and serve to secure the arm in any of a range of orientations about the pivot mount so provided. Adjustability of horizontal and vertical orientation is indicated by the double-headed arrows in FIGS. 7 and 8, respectively.

The turret arm 90 has a rearwardly directed extendsion 98, on which is mounted a chair piece 100, and it has a sighting piece 102 and handle pieces 105 affixed within an upper housing portion 104 thereof. A barrel portion 106 extends forwardly from the housing portion of the arm 90, and has a channel 107 formed through it, in which is received the cruciform shaft 108 of a bulbous, dart-like projectile, generally designated by the numeral 110. Near its end, the shaft 108 has notches 112 formed into the flange elements of which it is comprised.

A trigger piece 116 is pivotably supported within the housing portion of the turret arm 90 by an element 118, which extends transversely thereacross and through the circular opening 120 of the trigger piece, and it has an upwardly projecting abutment finger and latching dog element 122, 124, respectively. A coil spring 114 is retained within a compartment formed by two L-shaped elements 126 extending inwardly from each side of the housing portion, which elements also define a cruciform slot therebetween best seen in FIG. 7.

As will be appreciated, as the projectile 110 is inserted into the channel 107 of the barrel portion 106, the spring 114, bearing upon its inner end will be compressed. The trigger piece 116 will also be pivoted thereby, causing the dog 124 to engage within one of the notches 112 presented to it; the curciform slot defined by the L-shaped elements 126 will ensure proper orientation of the shaft 108 for establishing such interengagement. As a result, the projectile 100 will be loaded for firing, which can be effected simply by pressing the trigger piece 116 inwardly as indicated by the arrow in FIG. 8. The horizontal direction and trajectory of the projectile can readily be controlled by rotation of the turret assembly within the receptacle portion 38 and by adjustment of the inclination of the arm 90 within the arcuate channel 78, as hereinabove described.

Thus, it can be seen that the present invention provides a novel creature toy having movable appendages, wherein animation is achieved ina unique manner. The toy may be of turtle-like form and capable of simulating a walking action, and it may include a turret assembly to provide an object-launching feature. A toy is provided which is effective in its appearance and utility, is durable, is relatively uncomplicated and comprised of relatively few parts, and is relatively facile and inexpensive to manufacture.

Having thus described the invention, what is claimed is:

1. A creature toy having movable appendages, comprising:

a body having mounting means therewithin;

a superimposed pair of ring members disposed upon said body mounting means for rotation about a common axis, each of said ring members having thereon an actuating element accessible externally of said body and at least one appendage projecting from said body; and means attached to said ring members for biasing them in opposite directions about said axis, whereby simultaneous force upon said actuating elements may effect counter-rotation of said ring members for animation of said appendages.

2. The toy of claim 1 wherein said ring members are substantially identical and are disposed in an inverted relationship to one another.

3. The toy of claim 2 wherein said each of ring members comprises an annular portion from which said actuating element and appendage project outwardly in a non-diametric relationship to one another.

4. The toy of claim 3 wherein said actuating elements and appendages are symmetrically disposed on said body, and wherein said actuating elements are adjacent to one another.

5. The toy of claim 4 wherin said biasing means acts between said ring members.

6. The toy of claim 5 wherein said biasing means acts to separate said actuating elements, animation of said appendages being effected by alternatley squeezing together and releasing said actuating elements.

7. The toy of claim 2 wherein each of said ring members has a plurality of appendages thereon arranged to dispose at least one on each side of said body and adjacent an appendage of the other ring member, whereby rotation of said ring members will cause said adjacent appendages on each side to move toward and away from one another.

8. The toy of claim 3 wherein said mounting means comprises a generally cylindrical seat portion disposed within said body.

9. The toy of claim 8 wherein, in the normal disposition of said toy, said seat portion is vertically oriented and is slightly tapered in the upward direction.

10. The toy of claim 9 wherein said annular portions of each of said ring members has a multiplicity of rib formations projecting inwardly at equidistantly spaced locations thereabout to provide bearing surfaces thereon.

11. The toy of claim 1 wherein said body, appendages and actuating elements are configured, respectively, to resemble the body, limbs and tail of a turtle-like creature.

12. The toy of claim 1 wherein, in the normal orientation of said toy, said body has a top wall in which is defined an upwardly opening recess of circular cross section, and wherein said toy additionally includes a turret assembly having a circular base member rotatably mounted within said recess and an upstanding turret member having object-launching means thereon.

* * * * *